US011187454B2

(12) United States Patent
Schenkl et al.

(10) Patent No.: US 11,187,454 B2
(45) Date of Patent: Nov. 30, 2021

(54) EDGE PROTECTION MODULE FOR ATTACHMENT TO AN OUTER EDGE OF A SHELF

(71) Applicant: emz-Hanauer GmbH & Co. KGaA, Nabburg (DE)

(72) Inventors: Johann Schenkl, Bodenwohr (DE); Martin Brabec, Nabburg (DE); Markus Rauch, Pfreimd (DE); Matthias Wallner, Pfreimd (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 0 days.

(21) Appl. No.: 17/123,203

(22) Filed: Dec. 16, 2020

(65) Prior Publication Data

US 2021/0199370 A1 Jul. 1, 2021

(30) Foreign Application Priority Data

Dec. 30, 2019 (DE) ..... 102019009084.5

(51) Int. Cl.

| | |
|---|---|
| ***F25D 27/00*** | (2006.01) |
| ***F21V 3/02*** | (2006.01) |
| ***F21V 33/00*** | (2006.01) |
| ***F21W 131/305*** | (2006.01) |

(Continued)

(52) U.S. Cl.

CPC ..... *F25D 27/00* (2013.01); *F21V 3/02* (2013.01); *F21V 33/0044* (2013.01); *F21W 2131/305* (2013.01); *F21Y 2103/10* (2016.08); *F21Y 2115/10* (2016.08)

(58) Field of Classification Search

CPC ..... F25D 27/00; F21V 33/0044

See application file for complete search history.

(56) References Cited

U.S. PATENT DOCUMENTS

| | | | |
|---|---|---|---|
| 5,508,898 A | 4/1996 | McGovern | |
| 9,995,477 B2 * | 6/2018 | Miedema | F21V 33/0044 |

(Continued)

FOREIGN PATENT DOCUMENTS

DE 102012103912 A1 10/2013

OTHER PUBLICATIONS

DE Examination Report in co-pending application DE 10 2019 009 084.5, dated Jul. 2, 2020.

*Primary Examiner* — William N Harris

(74) *Attorney, Agent, or Firm* — Robert R. Deleault, Esq.; Hayes Soloway PC

(57) ABSTRACT

An edge protection module for attachment to an outer edge of a shelf of a domestic refrigerator, includes a metallic carrier strip having a strip axis, a lighting rod which is mounted on the carrier strip and extends along the strip axis and which has two axially opposite rod ends and a row of lighting elements, which are arranged in an axially distributed manner, and two connection points in electrical connection with the row of lighting elements, which connection points are arranged axially on both sides of the row of lighting elements in a defined axial position relative to the carrier strip and are accessible from outside the edge protection module, where at least one of the connection points is part of a contacting unit which is structurally separate from the lighting rod and is mounted on the carrier strip at an axial distance from the lighting rod.

12 Claims, 2 Drawing Sheets

(51) Int. Cl.
*F21Y 103/10* (2016.01)
*F21Y 115/10* (2016.01)

(56) References Cited

U.S. PATENT DOCUMENTS

2003/0137828 A1* 7/2003 Ter-Hovhannisian ..... A47F 3/0404 362/92
2004/0264160 A1* 12/2004 Bienick ..... F25D 25/02 362/602
2005/0081547 A1 4/2005 Avenwedde et al.
2007/0127229 A1* 6/2007 Lee ..... F25D 27/00 362/92
2008/0037239 A1* 2/2008 Thomas ..... F21V 29/83 362/92
2011/0164399 A1 7/2011 Driver et al.
2012/0106129 A1* 5/2012 Glovatsky ..... G02B 6/0095 362/92
2014/0268862 A1* 9/2014 Gooden ..... F25D 27/00 362/555
2015/0023000 A1 1/2015 Kendall et al.
2015/0354765 A1* 12/2015 Hannawa ..... F21V 21/005 362/92
2016/0161669 A1* 6/2016 Lee ..... F25D 27/00 362/621
2016/0327259 A1 11/2016 Pan et al.

* cited by examiner

EDGE PROTECTION MODULE FOR ATTACHMENT TO AN OUTER EDGE OF A SHELF

BACKGROUND OF THE INVENTION

1. Field of the Invention

The present invention relates generally to an edge protection module for attachment to an outer edge of a shelf.

2. Description of the Prior Art

Conventional refrigerators for domestic use are generally equipped with one or more shelves which are inserted into a refrigerator interior serving for the storage of foods and provide a horizontal support surface on which the foods are placed. Occasionally the shelves are removable, sometimes they are permanently fitted into the refrigerator. Frequently they are manufactured from a fragile glass material which has a tendency to splinter. When the user stands in front of the open refrigerator and wishes to place or put objects on one of the shelves, it can happen, out of carelessness, that the user hits the shelf with the objects in the region of the shelf front outer edge that is facing him. If the shelf front outer edge is unprotected, splinters can break out from one of the front outer edges of the shelf. In order to avoid this, shelves for use in a domestic refrigerator are often equipped with an edge protection strip attached in the region of the shelf front edge. Such edge protection strips are sometimes expanded in the prior art by the additional provision of a lighting function to form an edge protection module. The edge protection module can illuminate the regions located beneath the shelf or/and introduce light directly into the front outer edge of the shelf. For a conventional edge protection module with a lighting function, reference may be made, for example, to DE 10 2012 103 912 A1.

A conventional edge protection module has a metallic carrier strip which performs the mechanical protecting function of the edge protection module (impact protection). The lighting function of the edge protection module is performed by a lighting rod mounted on the carrier strip. In order to supply power to the lighting rod, the conventional edge protection module has two electrical connection points which are accessible from outside the edge protection module for contacting by external contact elements. It is desirable for these connection points to be arranged at fixed, unchangeable positions along the edge protection module so that, when the shelf is inserted into the refrigerator, reliable contacting of the connection points by the external contact elements is ensured.

A problem can occur in the case of the conventional edge protection module if the connection points are fixedly arranged on the lighting rod and the lighting rod exhibits different thermal expansion behaviour to the carrier strip. One or both of the connection points can then be displaced relative to their respective optimum position (optimum in respect of contacting by an external contact element) due to the temperature. This can limit the quality of the electrical contacting of the edge protection module and in an extreme case even result in the edge protection module being unable to receive any power at all.

SUMMARY OF THE INVENTION

An object of the present invention consists in providing an edge protection module which serves for attachment to an outer edge of a shelf and which ensures reliable electrical contacting by external contact elements.

In order to achieve this object there is provided according to the invention an edge protection module for attachment to an outer edge of a shelf, in particular in a domestic refrigerator, comprising: a metallic carrier strip having a strip axis, a lighting rod which is mounted on the carrier strip and extends along the strip axis and which has two axially opposite rod ends and a row of lighting elements, in particular of the diode type, which are arranged in an axially distributed manner, and also two connection points in electrical connection with the row of lighting elements, which connection points are arranged axially on both sides of the row of lighting elements in a defined axial position relative to the carrier strip and are accessible from outside the edge protection module for the purpose of electrical contacting of the edge protection module. At least one of the connection points is part of a contacting unit which is structurally separate from the lighting rod and is mounted on the carrier strip at an axial distance from the lighting rod.

The invention is based on the idea of arranging the connection points at defined longitudinal positions of the carrier strip and at the same time accommodating at least one of the connection points separately and remotely from the lighting rod in a contacting unit. The contacting unit can in turn be attached to the carrier strip at a defined axial position relative thereto. Different embodiments which permit temperature-related changes in length of the lighting rod without jeopardising the axial position accuracy of the connection points are thereby conceivable. The lighting rod can accordingly be fixed in position relative to the carrier strip in a defined manner in a single axial rod position, or there can be no axial fixing of any kind of the lighting rod in a predetermined, defined axial position relative to the carrier strip.

For example, in some embodiments a first of the connection points is arranged on the lighting rod in the region of a first of the rod ends, whereas the second of the connection points is part of the contacting unit and the contacting unit is arranged on the far side of the second of the rod ends of the lighting rod at an axial distance from the lighting rod. The lighting rod is thereby axially fixed relative to the carrier strip in the region of its first rod end and axially unfixed relative to the carrier strip over a remaining portion of its axial length reaching as far as the second rod end.

Unfixed here means that the lighting rod is not prevented from moving axially relative to the carrier strip. This does not exclude the possibility that the lighting rod is seated in the region of the remaining portion with a friction fit in a longitudinal sliding guide of the carrier strip—secured against loose slipping—provided that the longitudinal sliding guide is not so narrow that it would prevent temperature-related changes in length of the lighting rod. The axial fixing of the lighting rod relative to the carrier strip in the region of the first rod end can be achieved, for example, by inter-engaging positioning structures or by other positioning techniques (e.g. adhesive bonding). Owing to the absence of axial fixing over the remaining portion of the axial rod length, temperature-related changes in length of the lighting rod can proceed unhindered in the remaining portion; the axial distance between the lighting rod and the contacting unit creates the necessary free space for such axial changes in length of the lighting rod.

In other embodiments, the lighting rod is axially unfixed relative to the carrier strip over its entire axial length and thus also in the region of both rod ends. The two connection points can thereby each be accommodated in a separate contacting unit, that is to say a contacting unit having one of the connection points can be arranged on the carrier strip axially on both sides of the lighting rod, wherein at least one of the contacting units is at an axial distance from the lighting rod. In yet other embodiments, the lighting rod is fixed in an axially defined manner relative to the carrier strip in the region of its rod middle, wherein the lighting rod is axially unfixed relative to the carrier strip axially on both sides of the fixing point up to the respective rod end. In such embodiments too, a contacting unit having one of the contacting points is arranged on the carrier strip axially on both sides of the lighting rod, wherein advantageously each of the contacting units is at an axial distance from the lighting rod.

In all these embodiments, a temperature-related change in length of the lighting rod cannot lead to one or both of the connection points jumping out of their predetermined, defined axial positions to a certain extent because of a lack of free space for the change in length of the lighting rod.

In some embodiments, the lighting rod has a rod body of a glass or plastics material which is in the form of a hollow profile and is light-permeable at least in a part-region of its profile cross-section and in the cavity of which the lighting elements are accommodated.

The lighting elements are, for example, white light sources and can be formed by light-emitting diodes. They can be mounted on a strip circuit board which is pushed into a rod body of the lighting rod.

In some embodiments, each of the connection points has a connection contact, for example in the form of a plug contact, arranged on a contact carrier, wherein each of the contact carriers is positioned axially relative to the carrier strip by a latching connection, which if desired is releasable. The connection contact is intended for contacting by an external contact element, which is attached, for example, to a metal holding bar which serves for mounting the shelf on a back wall delimiting the inner cooling chamber of a refrigerator at the back. Such holding bars, which are frequently referred to among experts as brackets in English, are provided on the left and right side of the shelf (from the perspective of the observer standing in front of the refrigerator) and can be inserted into the refrigerator and removed therefrom again together with the shelf as an assembly group, see for example EP 3 147 607 A. Of course, the supply of power to the edge protection module via the metal material of such brackets is only an example and is in no way to be interpreted as being limiting; as an alternative, an external contact element can be arranged, for example, on a side wall delimiting the cooling chamber at the side.

For the axial positioning of the contacting unit relative to the carrier strip, inter-engaging positioning structures can be provided on the contacting unit and the carrier strip, for example in the form of a latching projection which latches with a snap fit into a latching opening.

In some embodiments, supply points which are electrically connected to the connection points are arranged in the region of the first rod end of the lighting rod for supplying power to the row of lighting elements. For both connection points, the associated supply points are accordingly located in the region of the same rod end of the lighting rod. In order to electrically connect the second connection point to its associated supply point, either a wire separate from the carrier strip can be used, or the metal material of the carrier strip can be used directly. Accordingly, in some embodiments, the electrical connection of the second connection point to an associated one of the supply points at least along a main portion of the axial length of the lighting rod is established via the metal material of the carrier strip or formed by a wire connection.

According to further aspects, the invention provides a shelf having an edge protection module of the type described hereinbefore attached thereto, and also a domestic refrigeration appliance, in particular in cabinet form, having a cooling chamber, which can be closed by a door, and a shelf inserted, if desired removably, into the cooling chamber, wherein the shelf is equipped on a shelf front outer edge with an edge protection module of the type described hereinbefore.

The invention will be described further hereinbelow by means of the accompanying drawings.

DETAILED DESCRIPTION OF THE INVENTION

The general construction of the edge protection module will first be described with reference to FIG. 1.

Figure 1:
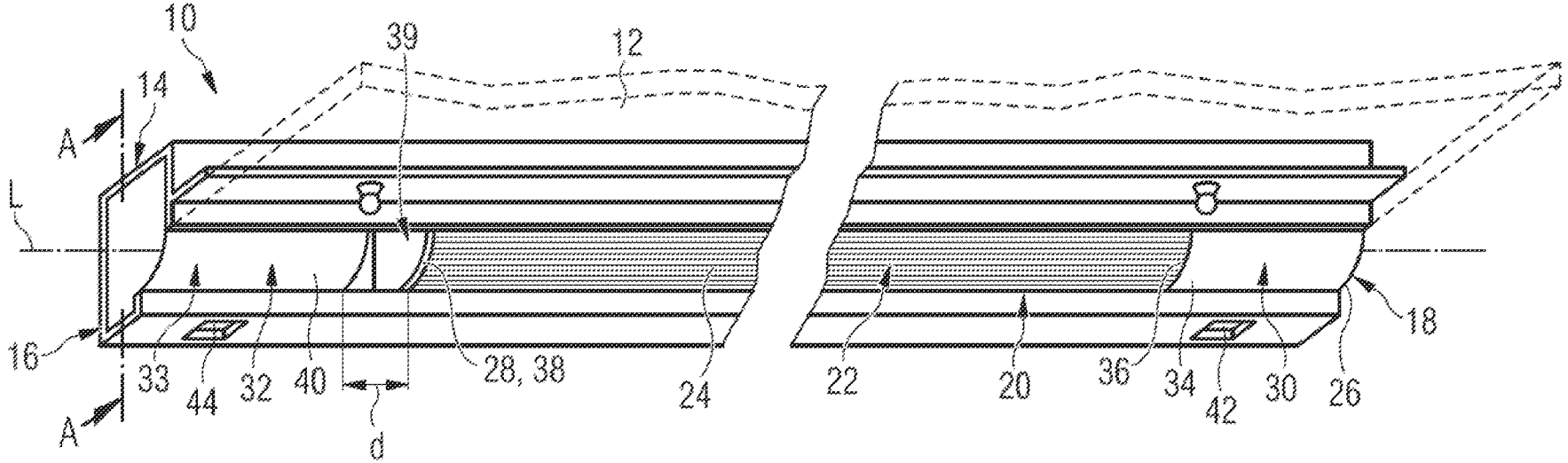
FIG. 1 is a perspective view of an edge protection module attached to a transparent shelf, looking obliquely from beneath from a compartment of a domestic refrigerator delimited at the top by the shelf.

FIG. 1 shows an edge protection module 10 which extends along an edge of a transparent shelf 12, which is only adumbrated. The edge protection module comprises a metallic carrier strip 14 having a strip axis L. The carrier strip 14 is configured with a sliding receiver 16 which extends along the strip axis L and has an opening portion 18 in the profile cross-section of the carrier strip 14. In FIG. 1, a lighting rod 20 is shown pushed into the sliding receiver 16 of the carrier strip 14. The lighting rod 20 has a rod body 22 in the form of a hollow profile. The rod body 22 is light-permeable at least in a part-region of its profile cross-section. This light-permeable region 24 of the rod body 22 extends along the opening portion 18 of the carrier strip 14 when the lighting rod 20 is received in the carrier strip 14.

The lighting rod 20 has two opposite rod ends 26 and 28 and is equipped with a row of lighting elements of the LED type arranged in an axially distributed manner, which will be discussed in greater detail hereinbelow with reference to FIG. 2. The lighting elements are not visible in FIG. 1 since they are received in the hollow interior of the rod body 22 of the lighting rod 20. Light emitted by the lighting elements leaves the lighting rod 20 through the light-permeable region 24 of the rod body 22 and further leaves the edge protection module 10 through the opening portion 18 of the carrier strip 14.

The lighting rod 20 is kept from loosely sliding to and fro along the strip axis L in the carrier strip 14 by means of a friction fit. The friction fit is such that a displacement of the lighting rod by a force effect which occurs, for example, when the longitudinal extent of the lighting rod 20, and in particular of the rod body 22 thereof, changes as a result of a temperature change is possible without difficulty.

There are further received in the sliding receiver 16 of the carrier strip 14 a first and a second connection point 30, 32, each in a defined axial position relative to the carrier strip 14. The first connection point 30 is shown in FIG. 1, when viewed in the direction of the plane of the drawing, to the right of the rod body 22 of the lighting rod 20, and a housing 34 thereof is shown as being connected without a gap to the rod body 22, so that the rod body 22 and the housing 34 of the first connection point 30 together form the lighting rod 20. In particular, the housing 34 of the connection point 30 can be adhesively bonded to a first end 36 of the rod body 22. The first end 36 of the rod body 22 is thus likewise fixed axially in position relative to the carrier strip 14. However, at least over a main portion of its axial length starting from the first end 36 of the rod body 22 up to the second end 38 of the rod body 22, the lighting rod 20 is axially unfixed relative to the carrier strip 14—apart from the friction fit in the sliding receiver 16. Depending on the longitudinal extent of the housing 34 along the longitudinal axis L, the main portion of the lighting rod 20 that is axially unfixed relative to the carrier strip 14 can account for at least 70% or at least 80% or at least 85% of the overall axial length of the lighting rod 20.

The opposite second end 38 of the rod body 22 is adhesively bonded to a closing cap 39.

The second connection point 32 is shown in FIG. 1, when viewed in the direction of the plane of the drawing, to the left of the lighting rod 20 as a contacting unit 33 formed separately from the lighting rod 20 and likewise has a housing 40. The second end 38 of the rod body 22, that is to say the second lighting rod end 28, and the housing 40 of the second connection point 32 are shown received in the carrier strip 14 spaced apart from one another by a distance d.

A material-related change in the longitudinal extent of the lighting rod 20 is accordingly possible at least in the main portion of the lighting rod 20 which is positionally unfixed relative to the carrier strip 14. The friction fit does not exclude this. Depending on the nature of the change in the longitudinal extent of the lighting rod 20, the distance d between the second end 38 of the rod body 22 and the housing 40 of the second connection point 32 becomes smaller or larger when the longitudinal extent of the lighting rod 20 changes. In any case, the distance d is chosen to be sufficiently large, in dependence on the material of the rod body 22, to accommodate any temperature-related longitudinal expansion of the rod body 22.

In order to fix the two connection points 30, 32 in the sliding receiver 16 in their defined positions axially relative to the carrier strip 14, the housings 34, 40 of the connection points 30, 32 can each have a latching mechanism for latching cooperation with the sliding receiver 16 of the carrier strip 14, and the sliding receiver 16 can be configured to permit latching with the latching mechanism of the two connection points 30, 32.

The two connection points 30, 32 are in electrical connection with the row of lighting elements and are accessible from outside the edge protection module 10 through openings 42, 44 in the carrier strip 14 for the purpose of electrical contacting of the edge protection module 10. The supply of power from outside can take place by means of so-called brackets, which can be provided for the positioning of shelves in domestic refrigerators and can be current-carrying if required.

Figure 2:
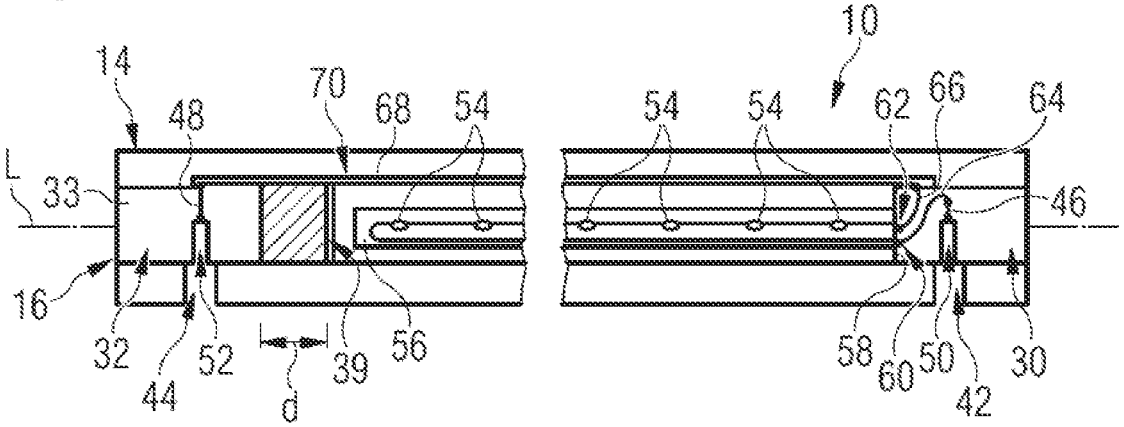
FIG. 2 is a schematic longitudinal sectional view of the edge protection module of FIG. 1 along axis A-A.

As is apparent from the schematic longitudinal sectional view of the edge protection module 10 of FIG. 1 shown in FIG. 2, each of the connection points 30, 32 has a connection contact 50, 52 arranged on a contact carrier 46, 48 for the purpose of the electrical contacting of the edge protection module 10 from outside. According to FIG. 2, the connection contact 50, 52 is configured as a plug contact, in particular it can be a spring-type plug contact. The supply of current from outside can take place by means of so-called brackets which are provided for the positioning of shelves in domestic refrigerators and are current-carrying if required. The connection contacts 50, 52 are accessible from outside through their associated openings 42, 44 provided in the carrier strip 14, when the connection points 30, 32 are fixed in their positions in the carrier strip 14.

The contact carrier 46, 48 of each connection point 30, 32 is in electrical connection with the plurality of lighting elements. The lighting elements are of the LED type in FIG. 2 and are provided with the reference numeral 54. The LEDs 54 are arranged in series and spaced apart from one another on a circuit board 56. The circuit board 56 is inserted into the rod body 22 of the lighting rod 20 and is supplied with power on one side with respect to the circuit board 56, namely on the power supply side 58, via two supply points 60, 62. For supplying power, one supply point 60 is connected to the contact carrier 46 of the first connection point 30 and the other supply point 62 is connected to the contact carrier 48 of the second connection point 32.

Electrical cables 64, 66, 68 are provided for the electrical connection of the supply points 60, 62 to the contact carriers 46, 48. The cable 68, which forms a portion of the electrical connection between the supply point 62 and the contact carrier 48 of the second connection point 32, which is received in the housing 40 spaced apart from the second end of the rod body 22 of the lighting rod 20, extends substantially along the longitudinal axis L of the carrier strip 14. A guide groove 70 for receiving the cable 68 in a guiding manner is formed in the carrier strip 14.

As an alternative to the cable 68, the electrical connection in this portion can also be achieved by the metallic carrier strip 14 itself. For this purpose, the connection points 30, 32 can be configured with electrical contact means, such as, for example, spring contacts, which electrically contact the metal of the carrier strip 14 when the connection points 30, 32 are seated in the carrier strip. Accordingly, an electrical connection between the LEDs 54 of the lighting rod 20 and the second connection point 22 mounted in the carrier strip 14 spaced apart from the lighting rod 20 can also be formed without a cable 68.

Figure 3:
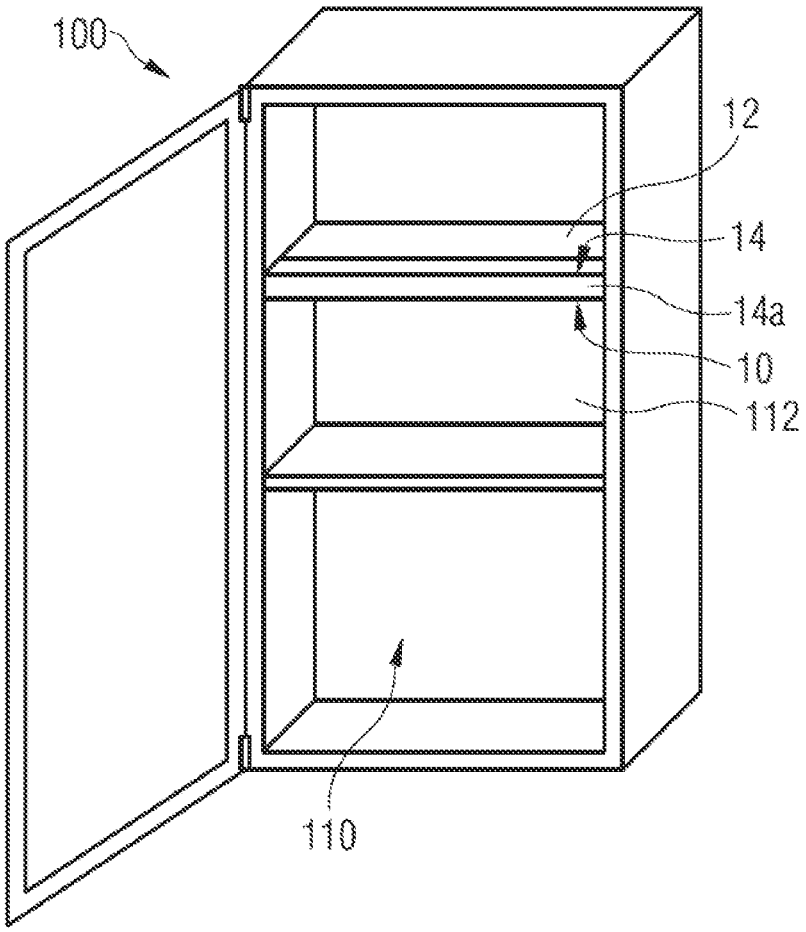
FIG. 3 shows a domestic refrigerator having a shelf provided with the edge protection module according to FIG. 1.

FIG. 3 shows a domestic refrigerator 100 having a shelf 12 provided with the edge protection module 10. The edge protection module 10 is attached to the shelf 12 as indicated in FIG. 1. The shelf 12 can be adhesively bonded to the edge protection module 10 or connected in another way, optionally also releasably. It is also conceivable that the edge protection module 10 is merely pushed onto an edge of the shelf 12. Preferably, the edge protection module 10 is then held on the shelf 12 by means of a friction fit.

When looking into an interior 110 of the domestic refrigerator 100 according to FIG. 3, an outer side **14*a* of the carrier strip 14 faces the user. This outer side 14*a* is the rear side of the carrier strip 14 in the view according to FIG. 1, which is not visible in FIG. 1. The sliding receiver 16 and thus also the lighting rod 20 mounted therein are accordingly remote from the user when looking in the direction of the interior 110 of the domestic refrigerator 100 according to FIG. 3. Accordingly, if the edge protection module 10 is attached to a shelf 12 and the shelf is inserted into a domestic refrigerator 100, as shown in FIG. 3, then the lighting rod 20 is oriented to illuminate a compartment 112, which is delimited at the top by the shelf 12, and to illuminate the shelf 12 from beneath. A dazzling effect on the user looking into the interior 110 of the domestic refrigerator 100 by the light of the LEDs 54** is therefore avoided.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. Edge protection module for attachment to an outer edge of a shelf, in particular in a domestic refrigerator, the edge protection module comprising:

a metallic carrier strip having a strip axis;

a lighting rod which is mounted on the carrier strip and extends along the strip axis and which has two axially opposite rod ends and a row of lighting elements which are arranged in an axially distributed manner; and two connection points in electrical connection with the row of lighting elements, which connection points are arranged axially on both sides of the row of lighting elements in a defined axial position relative to the carrier strip and are accessible from outside the edge protection module for the purpose of electrical contacting of the edge protection module, wherein at least one of the connection points is part of a contacting unit which is structurally separate from the lighting rod and is mounted on the carrier strip at an axial distance from the lighting rod, wherein a first of the connection points is arranged on the lighting rod in a region of a first of the rod ends, wherein the second of the connection points is part of the contacting unit and the contacting unit is arranged on a far side of a second of the rod ends of the lighting rod at an axial distance from the lighting rod, wherein the lighting rod is axially fixed relative to the carrier strip in the region of its first rod end and is axially unfixed relative to the carrier strip over a remaining portion of its axial length reaching as far as the second rod end.

2. The edge protection module according to claim 1, wherein the lighting elements are LEDs.

3. The edge protection module according to claim 1, wherein supply points which are electrically connected to the connection points are arranged in the region of the first rod end of the lighting rod for supplying power to the row of lighting elements, wherein the electrical connection of the second connection point to an associated one of the supply points at least along a main portion of the axial length of the lighting rod is established via the metal material of the carrier strip or formed by a wire connection.

4. The edge protection module according to claim 1, wherein each of the connection points has a connection contact arranged on a contact carrier, and each of the contact carriers is positioned axially relative to the carrier strip by a latching connection.

5. The edge protection module according to claim 1, wherein the carrier strip forms a sliding receiver for the lighting rod.

6. The edge protection module according to claim 1, wherein the lighting rod has a rod body of a glass or plastics material which is in the form of a hollow profile and is light-permeable at least in a part-region of its profile cross-section and in a cavity of which the lighting elements are accommodated.

7. The edge protection module according to claim 4, wherein the connection contact is in the form of a plug contact.

8. The edge protection module according to claim 4, wherein the latching connection is releasable.

9. An edge protection module for attachment to an outer edge of a shelf, in particular in a domestic refrigerator, comprising:

a metallic carrier strip having a strip axis;

a lighting rod which is mounted on the carrier strip and extends along the strip axis and which has two axially opposite rod ends and a row of lighting elements which are arranged in an axially distributed manner; and two connection points in electrical connection with the row of lighting elements, which connection points are arranged axially on both sides of the row of lighting elements in a defined axial position relative to the carrier strip and are accessible from outside the edge protection module for the purpose of electrical contacting of the edge protection module, wherein at least one of the connection points is part of a contacting unit which is structurally separate from the lighting rod and is mounted on the carrier strip at an axial distance from the lighting rod, and wherein the lighting rod is fixed in an axially defined manner relative to the carrier strip in the region of its rod middle and is axially unfixed relative to the carrier strip axially on both sides of a fixation point up to the respective rod end.

10. The edge protection module according to claim 9, wherein the two connecting points are each accommodated in a separate contacting unit on the carrier strip axially on both sides of the lighting rod, and wherein at least one of the contacting units is at an axial distance from the lighting rod.

11. An edge protection module for attachment to an outer edge of a shelf, in particular in a domestic refrigerator, comprising:

a metallic carrier strip having a strip axis;

a lighting rod which is mounted on the carrier strip and extends along the strip axis and which has two axially opposite rod ends and a row of lighting elements which are arranged in an axially distributed manner; and two connection points in electrical connection with the row of lighting elements, which connection points are arranged axially on both sides of the row of lighting elements in a defined axial position relative to the carrier strip and are accessible from outside the edge protection module for the purpose of electrical contacting of the edge protection module, wherein at least one of the connection points is part of a contacting unit which is structurally separate from the lighting rod and is mounted on the carrier strip at an axial distance from the lighting rod, and wherein the lighting rod is axially unfixed relative to the carrier strip over its entire axial length including a region of both rod ends.

12. The edge protection module according to claim 11, wherein the two connecting points are each accommodated in a separate contacting unit on the carrier strip axially on both sides of the lighting rod, and wherein each of the contacting units is at an axial distance from the lighting rod.

* * * * *